US006522080B1

(12) United States Patent
Faillon et al.

(10) Patent No.: US 6,522,080 B1
(45) Date of Patent: Feb. 18, 2003

(54) FIELD EMITTER ARRAY WITH ENHANCED PERFORMANCE

(75) Inventors: Georges Faillon, Meudon (FR); Dominique Dieumegard, Mareil-Marly (FR); Christian Brylinski, Neuilly S/Seine (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/926,008

(22) PCT Filed: Feb. 11, 2000

(86) PCT No.: PCT/FR00/00346

§ 371 (c)(1),
(2), (4) Date: Aug. 13, 2001

(87) PCT Pub. No.: WO00/48220

PCT Pub. Date: Aug. 17, 2000

(30) Foreign Application Priority Data

Feb. 12, 1999 (FR) ..... 99 01721

(51) Int. Cl.[7] ..... G09G 3/10
(52) U.S. Cl. ..... 315/169.3; 313/309; 313/310
(58) Field of Search ..... 315/169.1, 169.3; 313/309, 310, 336, 351, 581, 585

(56) References Cited

U.S. PATENT DOCUMENTS

| | | | | |
|---|---|---|---|---|
| 4,575,765 A | * | 3/1986 | Hirt | 348/800 |
| 5,268,648 A | | 12/1993 | Calcatera | 313/309 |
| 5,731,597 A | | 3/1998 | Lee et al. | 313/309 |
| 5,847,408 A | * | 12/1998 | Kanemaru et al. | 257/10 |

OTHER PUBLICATIONS

C. A. Spindt, et al., Journal of Vacuum Science & Technology, Part B, vol. 11, No. 2, pp. 468–473, "Field–Emitter–Array Development for High–Freqeuncy Operation," Mar. 1, 1993.

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A microwave modulable field-effect cathode which includes at least one array of emissive tips. A microwave modulation signal is produced by a device including a microwave-controllable semiconductor modulation element which is close to the tip array, and a short microline for conveying the modulation signal to the tip array. The microline provides impedance matching between the tip array and the semiconductor modulation element. Such a device can find application as a compact field-effect cathode, as one example.

18 Claims, 10 Drawing Sheets

FIELD EMITTER ARRAY WITH ENHANCED PERFORMANCE

TECHNICAL FIELD OF THE INVENTION

The present invention relates to field-effect cathodes (also called field emission arrays, i.e. FEAs). These cathodes have been already used in certain types of experimental high-power electron tubes, such as relativistic magnetrons, vircators, etc., but also in new tubes of more conventional types, such as travelling wave tubes for applications in radar or in telecommunications.

BACKGROUND OF THE INVENTION

In this second case, the cathode is formed from at least one array of tips, comprising a substrate covered by a dielectric layer with cavities, each cavity receiving a protruding emissive tip, and a grid placed on the surface of the dielectric layer at least partially surrounds the cavities.

To extract electrons from the tips, a potential difference is applied between the grid and the tips. The electron emission may be modulated in terms of density by modulating the voltage applied to the grid.

From an electrical standpoint, the grid and the substrate/tips assembly, which are separated by the dielectric layer, are equivalent to a capacitance of the order of 10 to 100 pF/mm$^2$ and the corresponding conductance is of the order of a few tens of mS/mm$^2$ at around 10 GHz.

Typically, if about 80 V is applied between the grid and the substrate/tips assembly, it is possible to extract a current of 1 $\mu$A/tip, the tips having a density of the order of $10^6$ to $10^7$ per square centimetre.

At frequencies from 10 to 100 kHz, the impedance presented by the grid to the modulator which feeds it is essentially real and remains about a few tens of ohms. This allows a modulator of reasonable power to be used.

Developments underway relate to the operation of these microwave field-effect cathodes. The advantage of an electron tube using such a microwave-modulated cathode is that it can be very compact, it can be constructed without the need for a focussing device and it has a high efficiency. It may be expected to obtain tubes whose operating principle will be comparable to that of IOTs (Inductive Output Tubes), but which operate at much higher frequencies.

However, if the grid is microwave-modulated, the impedance presented by the grid to the modulator which feeds it becomes very low because the capacitor has a very low reactance (0.1 to 1 $\Omega$/mm$^2$ at around 10 GHz, for example). This requires a modulator with a bandwidth equivalent to that of conventional tubes, with a very high power, in order to obtain a satisfactory current intensity.

The modulator is connected to the grid via a microwave transmission line, generally a microstrip line. Another reason for requiring the modulator to have a high power is that the modulation signal applied to the gate is reflected at the transition between the transmission line and the grid.

In this regard, FIG. 1*a* shows, seen from above, a field-effect cathode of known type. The cathode 1 comprises four sector-shaped tip arrays 2, grouped together on the same electrically conducting support 50. Each array comprises a conducting substrate denoted 3, a dielectric layer denoted 4 with cavities 5 in which emissive tips 6 are placed, the dielectric layer being surmounted by a grid 7. Reference may also be made to FIG. 1*b*.

The electrical power for each of the arrays 2 is supplied by means of microstrip lines 8 each connecting a tip array 2 to a power modulator M located some distance away. The diagram in FIG. 1*a* shows one modulator M for each tip array 2, but only one modulator may suffice for all of them. The microstrip lines 8 are long and occupy a much larger area than the tip arrays 2. The modulator M cannot be brought very close to the tip arrays 2, as it is much bulkier than the tip arrays.

In the configuration described and illustrated, the conducting support 50 serves as a conducting plane for the microwave lines 8. The insulation of the microstrip lines is denoted 8.2 and the conducting strip is denoted 8.3.

Each microstrip line 8 is electrically connected to a tip array 2 via a conductor 9 attached on one side to the conducting strip 8.3 and on the other side to the grid 7 of the tip array 2.

The modulators M must generate a high-level microwave signal, especially because, since they are located quite far from the tip arrays 2, they are connected thereto via lines which cause a strong reflection on the grid side and because reflections also occur in the tip arrays 2 owing to the presence of the tips 6.

The further away from the microstrip line 8, penetrating the tip array 2, the weaker the signal and the lower the current density produced by the tips. This results in an inhomogeneous electron beam, prejudicial to proper operation of an electron tube. The modulation signal becomes ineffective beyond 100 micrometres' propagation into the tip array 2.

The sector shape given to the tip arrays 2 makes it possible, if a width of 50 to 100 micrometres is not exceeded, to improve the homogeneity of the beam. However, the current density is limited as it is not possible to get close to a large number of tip arrays without considerably increasing the area occupied because of the space taken up by the microstrip lines coming from the modulator M.

SUMMARY OF THE INVENTION

It is an object of the invention to provide a cathode not having these drawbacks. The present invention provides a microwave-modulable, field-effect cathode, formed from at least one array of emissive tips, which is capable of emitting electrons with a current density much higher than that of the existing field-effect cathodes. This cathode has the advantage of requiring neither a conventional power modulator for controlling electron emission nor a high-level transmission line. Conventional modulators are expensive, greedy in terms of electricity and pose cooling problems. Transmission lines pose problems of differential phase lags in the microwave signal and attenuation problems.

To achieve this, the present invention is a microwave-modulable field-effect cathode, comprising at least one emissive tip array, means for producing a microwave modulation signal and means for conveying the modulation signal to the tip array, characterized in that the means for producing the modulation signal comprise a microwave-controllable semiconductor modulation element which is situated very close to the tip array, the means for conveying the modulation signal to the tip array being a short microline which introduces practically negligible perturbation and achieves impedance matching between the tip array and the semiconductor modulation element.

The microline is especially a line of the microstrip or coplanar type, the conducting strip of which is connected at one of its ends to the tip array and at he other end to the semiconductor modulation element.

The semiconductor modulation element is of the transistor, especially MESFET, type or of the diode type.

To achieve impedance matching, the conducting strip of the microline may be configured divided into two lengths joined together by a capacitor.

The microline may also have a bias function and be connected to a bias voltage source.

At least one element from among the tip array, the semiconductor modulation element and the microline is a discrete component.

At least two elements from among the tip array, the semiconductor modulation element and the microline are attached to the same electrically insulating or semi-insulating support. The two elements may be mounted on one side of the support, the other side of which is coated with a conducting layer which serves as an earth plane.

It is possible to connect the microline to the tip array and/or to the semiconductor modulation element via a wire link.

However, to prevent emission perturbations, it is advantageous to avoid wire links into the tip array. The tip array comprises an electrically insulating or semi-insulating substrate with, on one side, a conducting or semiconducting layer, emissive tips in electrical contact with the conducting or semiconducting layer, a dielectric layer provided with cavities, each housing one of the tips, the dielectric layer being surmounted by a conducting grid which at least partially surrounds the cavities. Passing through the substrate is at least one plated-through hole which is used to electrically connect the tips to the other side of the substrate. The plated-through hole may be extended by a contact which is attached to a suitable conducting contact pad on the support.

Passing through the substrate and the dielectric layer may also be at least one plated-through hole which is used to electrically connect the gate to the other side of the substrate. Wire links associated with the tips and/or the gate can therefore be eliminated.

To eliminate one or more wire links into the semiconductor modulation element, it is possible to use a component compatible with a flip-chip technique.

The microline can be easily produced in a form integrated into the electrically insulating or semi-insulating support, even if the tip array and/or the semiconductor modulation element are discrete components.

To obtain a compact and relatively inexpensive tip-effect cathode, it is beneficial for the tip array, the microline and the semiconductor modulation element to be integrated on the same semiconductor substrate. Preferably, the semiconductor employed is a semi-insulator such as silicon carbide.

The microline may therefore have a strip which is extended on one side to form a grid for the tip array and on the other side to form a contact for the semiconductor modulation element.

BRIEF DESCRIPTION OF THE DRAWINGS

The present invention will be more clearly understood and further advantages will become apparent from the description which follows and from the appended figures which show.

DETAILED DESCRIPTIONS OF THE INVENTION

The various components of the cathodes according to the invention have not been shown to scale for the sake of clarity.

Figure 1A:
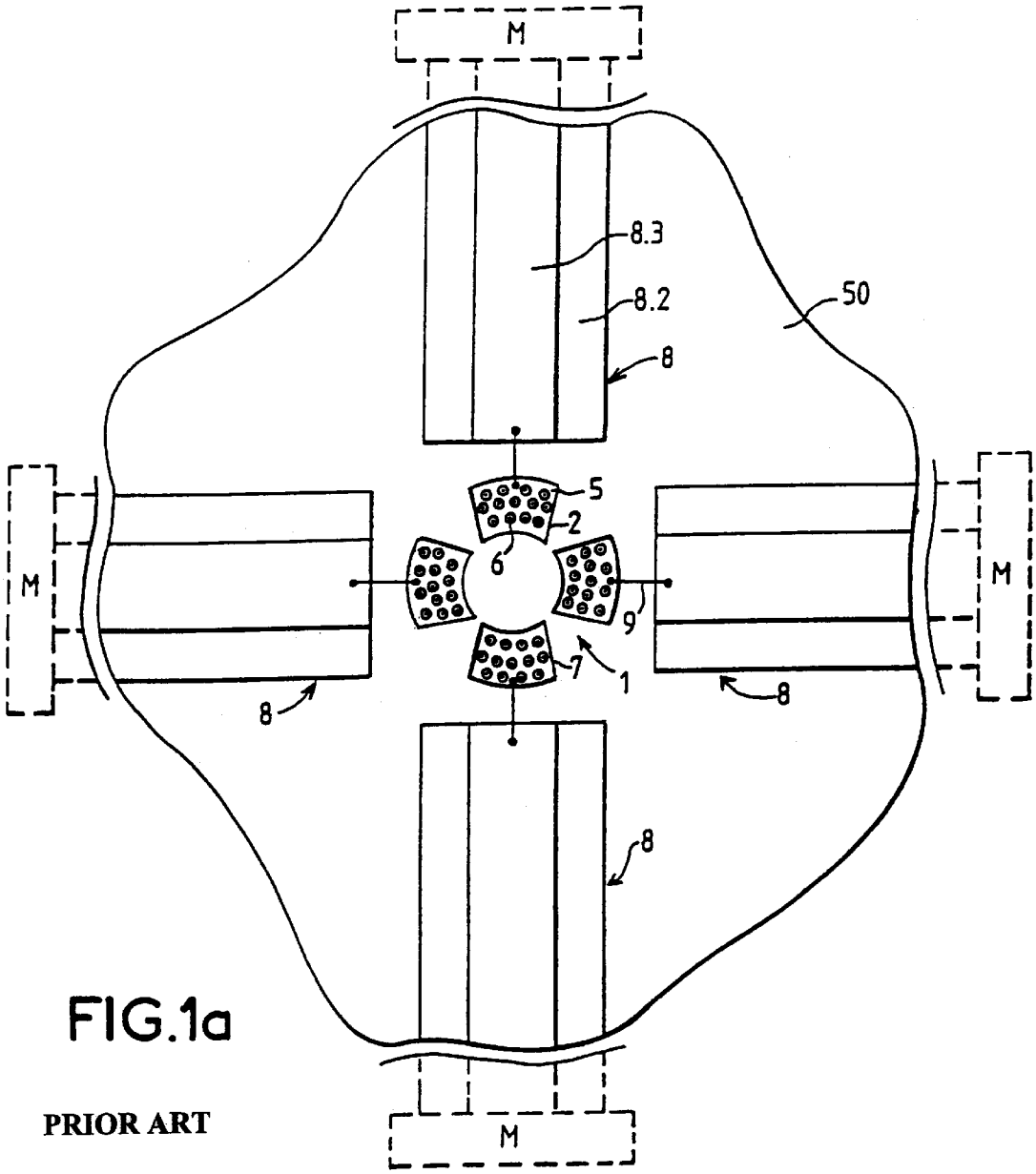
FIG.1a PRIOR ART
FIGS. 1*a*, 1*b*, already described, a plan view and a partial sectional view of a known field-effect cathode.
Figure 1B:
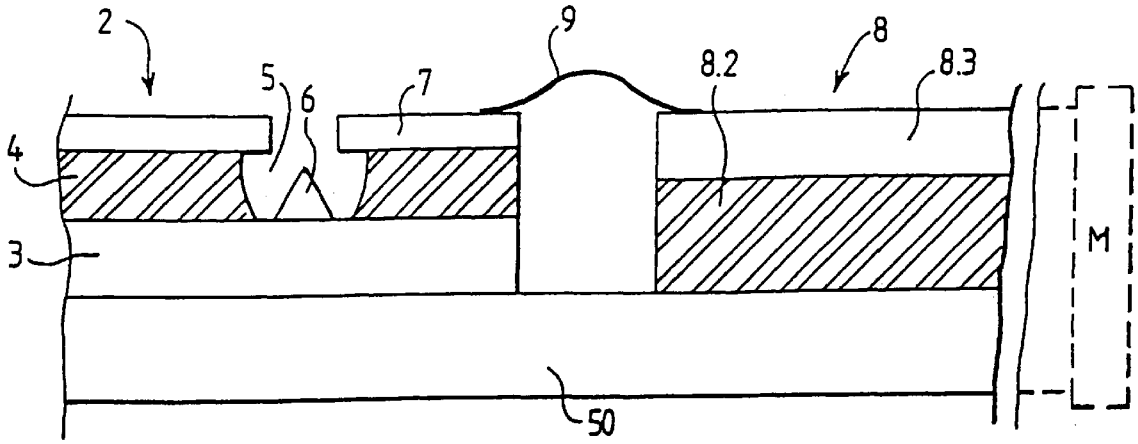
FIG.1b PRIOR ART
Figure 2:
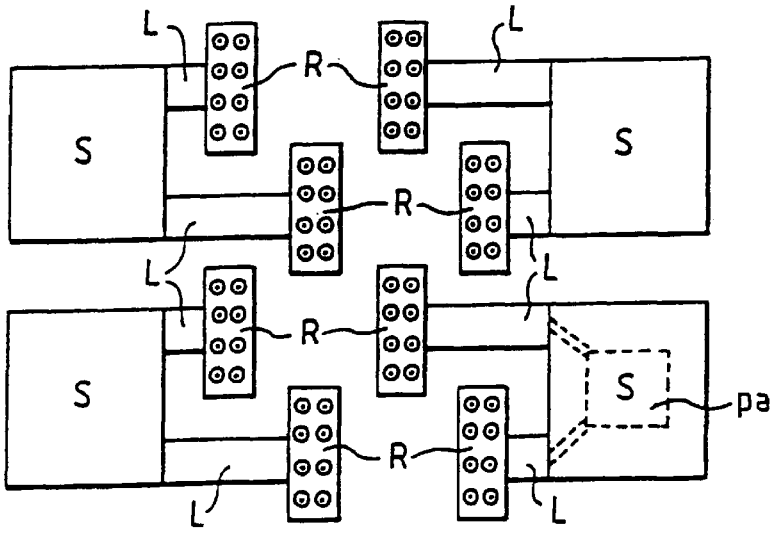
FIG. 2, a plan view of one embodiment of a field-effect cathode according to the invention.

FIG. 2 shows schematically, seen from above, a microwave modulable field-effect cathode according to the invention.

The cathode comprises at least one tip array A, which is itself conventional, means S for producing a microwave modulation signal which controls the electron emission and means L for conveying the signal to the tip array A.

According to the invention, the means S for producing the microwave modulation signal comprise a semiconductor modulation element placed just beside the tip array A, while the means for conveying the signal to the tip array A are a short microline introducing a practically negligible perturbation. The microline merely has the role of electrically linking the tip array to the semiconductor modulation element. It also has the function of providing impedance matching between the tip array and the semiconductor modulation element. Moreover, it can also convey at least one bias voltage.

In this way, it is possible to dispense with a bulky and expensive conventional power modulator and with a high-level line, which modulator and line would pose problems. Such a semiconductor modulation element S can control the emission from several tip arrays A.

The arrangement of the tip arrays A offers a very large number of options. It is possible to concentrate on a small surface area a large number of tip arrays A, thereby allowing higher current densities to be obtained. Each tip array A may have optimum dimensions so that there is no or very little perturbation of the modulation signal in the tip array A, thereby making it possible to obtain electron beams which are much more homogeneous than in the past. Typical dimensions for such a tip array A are around 50 micrometres by 300 micrometres. Propagation over a distance of about 50 micrometres produces no appreciable perturbation at around 10 GHz.

The semiconductor modulation element S which delivers the microwave modulation signal may, for example, be a transistor or a diode. In the case of a MESFET transistor, its area is about 500 micrometres by 200 micrometres, with a substantially smaller active part AP of about 50 micrometres by 200 micrometres. The microline L itself may have a length of approximately 100 micrometres, or even several hundreds of micrometres, without introducing appreciable perturbation.

Figure 3A:
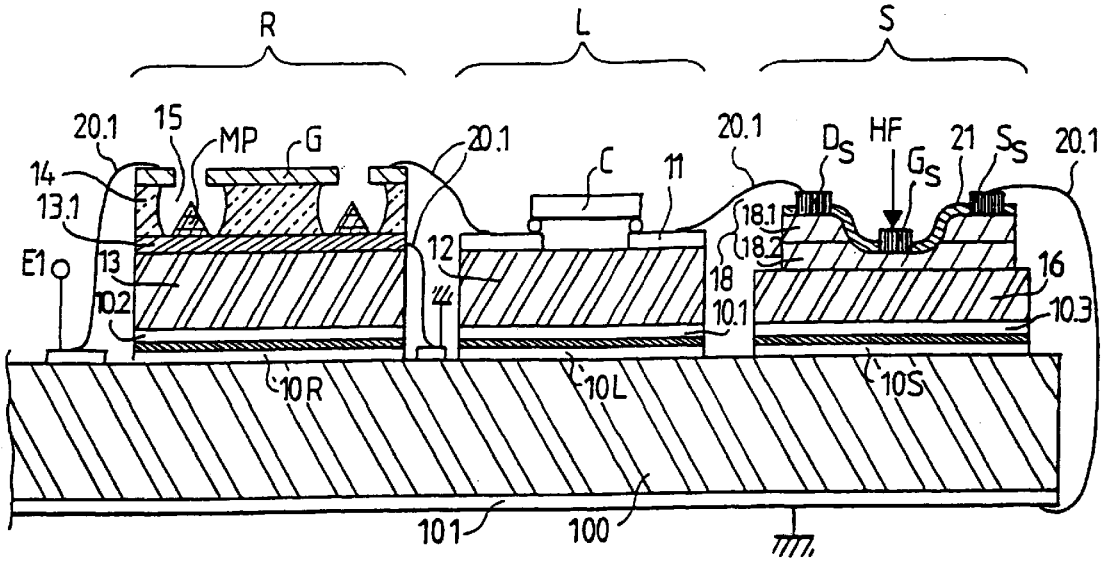
FIGS. 3*a*, 3*b*, embodiments of field-effect cathodes according to the invention in which the semiconductor modulation element is a transistor or a diode.

FIG. 3*a* shows in section, an example of a field-effect cathode according to the invention. In this configuration, the tip array A, the microline L and the semiconductor modulation element S are discrete components and fastened to the same dielectric support 100. In this example, the tip array A, the microline L and the semiconductor modulation element S are each attached by soldering to a conducting contact pad 10A, 10L, and 10S respectively, carried on one side of the dielectric support 100. The solder is shown as a darkened thick line. This dielectric support 100 plays an essentially mechanical role, but it may be beneficial to place on its other main side a conductive coating 101 so as to produce a local earth plane.

In the example described, it is assumed that the microline L is a microstrip line. It is conceivable for this to be a coplanar line and in the cross-sectional figure it would have the same outline. The microstrip line L conventionally comprises a conducting plane 10.1 or earth plane, then an electrically insulating or semi-insulating layer 12 followed by a conducting strip 11. A conducting plane 10.1 is attached to the conducting pad 10L of the dielectric support 100. The conducting plane 10.1 and the conducting strip 11 may be made of nickel or an alloy based on titanium, gold, platinum, for example. The electrically insulating or semi-insulating layer 12 may be made of a ceramic, silica or even silicon carbide for example.

Figure 6A:
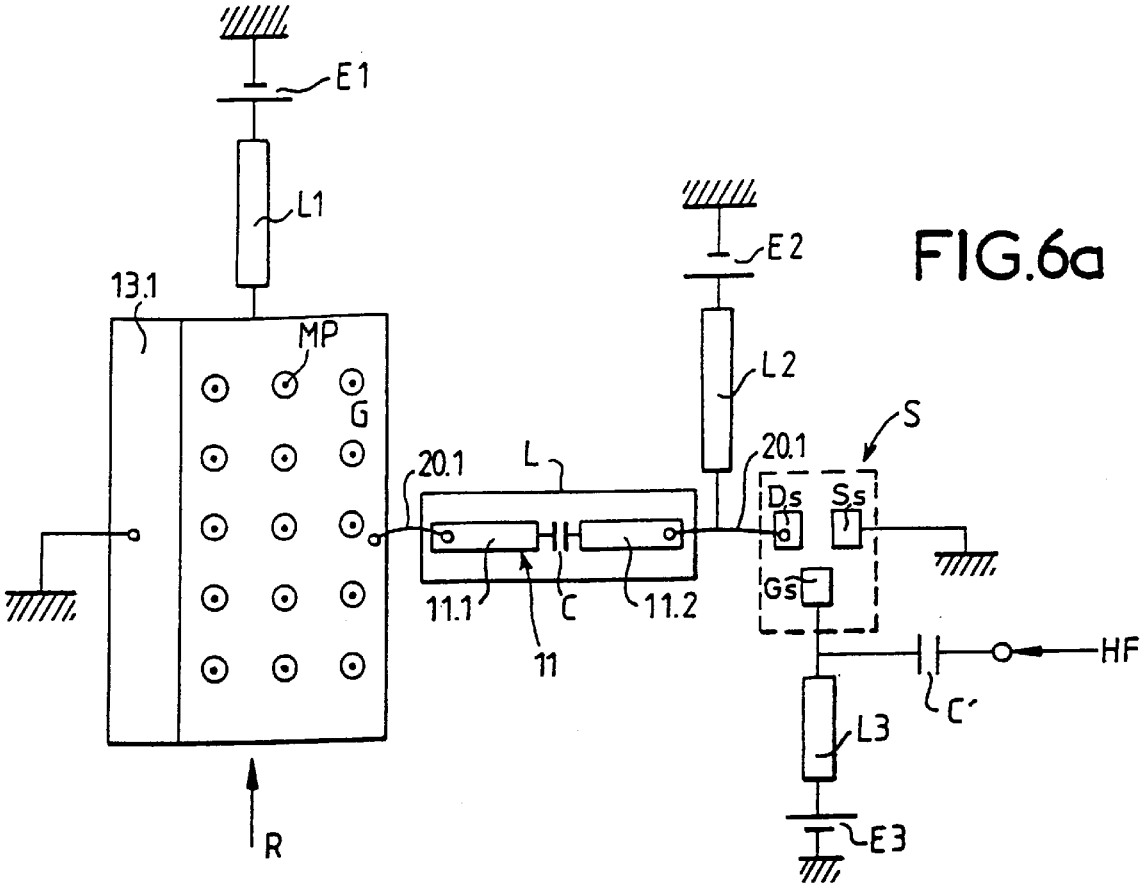
FIGS. 6*a*, 6*b*, examples of circuit diagrams for mounting field-effect cathodes according to the invention.

As will be seen later in FIGS. 6*a* and 6*b*, the strip 11 of the microline L may be discontinuous and formed from two lengths joined together by a capacitor C, for example attached between the two lengths. This capacitor C is used for the impedance matching.

The tip array A comprises an electrically insulating or semi-insulating substrate 13 with, on one side, a conducting or semiconducting layer 13.1, emissive tips ET in electrical contact with the conducting or semiconducting layer 13.1, and a dielectric layer 14 provided with cavities 15, each housing one of the tips ET, the dielectric layer 14 being surmounted by a conducting grid G which at least partially surrounds the cavities 15. The other side of the substrate 13 is coated with a conductive coating 10.2 in order for it to be soldered to the dielectric support 100.

When the substrate 13 is insulating, it may for example be made of glass, alumina or silica and when it is semi-insulating it may be made, for example, of silicon carbide SiC. The materials of the substrate 13 are chosen for their ability to withstand high voltages, for example of the order of a few hundred volts, without any damage, and high temperatures, for example of about 400° C., these temperatures being reached when the cathode is fitted into a microwave tube which is put into a vacuum oven in order to obtain a high vacuum. In general, all the materials involved in the composition of the cathode according to the invention must be able to withstand the oven treatment and must not outgas under vacuum.

The dielectric layer 14 may be made of silica $SiO_2$ for example and the grid G and the tips ET made of molybdenum for example.

The semiconductor modulation element S in the example in FIG. 3*a* is a transistor. More specifically, in this example it is a MESFET-type transistor, but of course, other types of transistors can be used. It comprises a conducting layer 10.3 for the soldering, then a substrate 16 made of a semiconductor material having semi-insulating properties, then an n-type semiconductor coating 18, preferably produced as two layers 18.1, 18.2, the contact layer or surface layer 18.1 being n+-doped and therefore more conducting than the n-doped active layer or base layer 18.2, then two ohmic contacts, a drain $D_s$ and a source $S_s$, and a Schottky gate contact $G_s$ between the ohmic contacts $D_s$ and $S_s$. Also shown in this example is a passivation layer 21 on the coating 18, it being possible for this layer to be made of silica for example.

The microline L is connected at one of its ends to the semiconductor modulation element S in the example shown at its drain $D_s$, and at its other end to the tip array A, in the example at the grid G. The grid G of the tip array A is raised to a bias voltage E1 and the tips ET are at earth potential. The source $S_s$ of the semiconductor modulator element S is connected to earth potential and the gate $G_s$ receives a microwave modulation signal MW which the semiconductor element amplifies. The links described above may be produced by wire bonding using wires 20.1, for example gold wires.

Figure 3B:
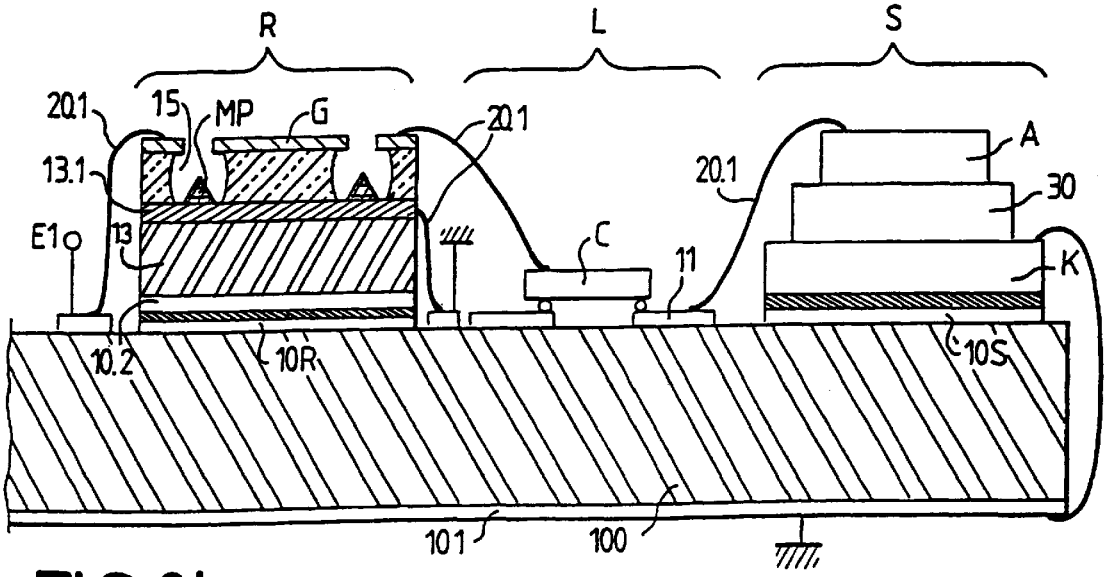

In FIG. 3*b*, the semiconductor modulation element S is now a diode, which may, for example, be of the Gunn or IMPATT type. It comprises a first conducting layer CA, which forms the cathode and will be soldered to the appropriate conducting pad 10S on the dielectric support 100. Its anode AN is formed by a second conducting layer and these two conducting layers AN and CA are separated by a semiconducting layer 30. Its cathode CA is connected to earth and its anode AN is connected to one end of the microline L.

With regard to the tip array A, FIG. 3*b* differs from FIG. 3*a* by the fact that the electrically conducting or semiconducting layer 13.1 is obtained by surface-doping the semi-insulating layer 13 thus made of a semiconductor material having semi-insulating properties, for example, silicon carbide. In the example, the tips ET are also made of the semiconductor material having semi-insulating properties which is rendered semiconducting by doping. The tips ET could, of course, be made of an electrically conducting material, such as molybdenum.

As regards the microline L, this is now integrated into the dielectric support 100. Its strip 11 is a conducting pad carried by the dielectric support 100, on that side to which the tip array A and the semiconductor modulation element S are attached. Its earth plane is formed by the conducting layer 101. One function of the microstrip is to act as a screen preventing radiation leakage. FIG. 3*b* also shows the strip 11 divided into two lengths and the capacitor C.

The techniques used to produce the tip array A may be those conventionally used in the semiconductor industry. An illustrative example is shown in FIGS. 4*a* to 4*e*. These figures illustrate the case of a discrete tip array like that shown in FIG. 3*a*.

Figure 4A:
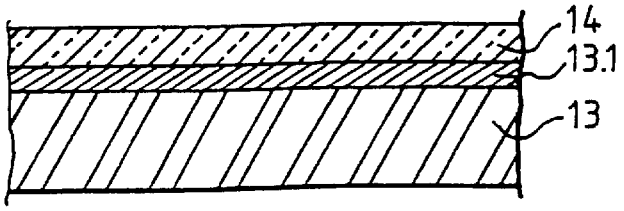
FIGS. 4*a* to 4*e*, various steps for producing the tip array of a field-effect cathode according to the invention.

The process starts with an electrically insulating or semi-insulating substrate 13. In the example, this is assumed to be made of glass for example. An electrically conducting layer 13.1, for example made of molybdenum, is deposited on top of the glass by vacuum evaporation. Next, the dielectric layer 14, which may, for example, be made of silica, is deposited (FIG. 4*a*).

Figure 4B:
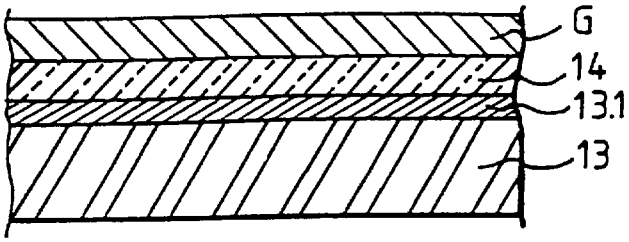
Figure 4C:
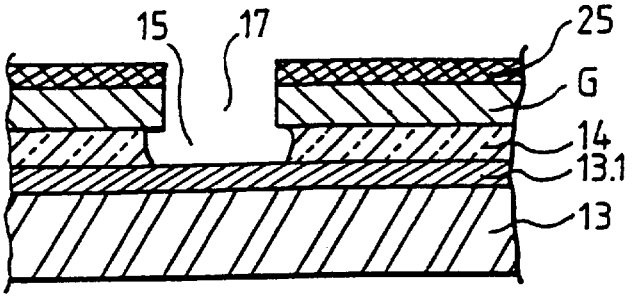

The grid G, for example made of molybdenum, is then deposited (FIG. 4*b*). After a masking operation, for example using lithography, the conducting grid layer G is etched, by chemical etching or by reactive ion etching (RIE), in order to form apertures 17, and then the dielectric layer 14 in order to form the cavities 15 (FIG. 4*c*). The apertures 17 run into the cavities 15.

Figure 4D:
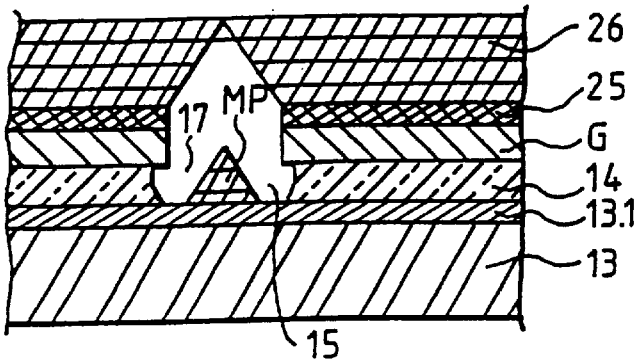
Figure 4E:
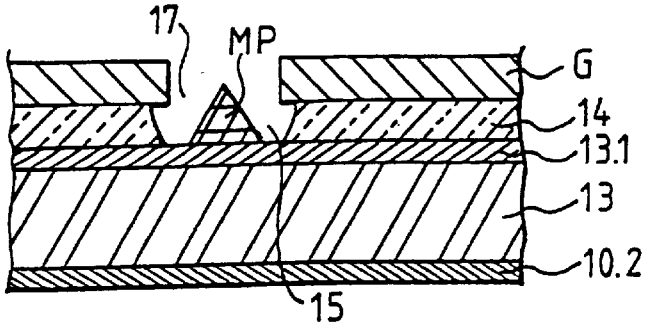

The tips ET, for example made of molybdenum Mo, may be deposited by vacuum evaporation (FIG. 4*d*).

Next, everything lying above the grid G (FIG. 4*e*), that is to say the resin 25 which serves for the masking operation and the excess metal from the tips ET which lies on the resin 25 and is labelled 26, are removed by chemical etching. The substrate 13, on its opposite side from that carrying the tips ET, is metallized at 10.2 in order to be able to attach the tip array A to the dielectric support 100 by soldering, for example using a gold solder. This step could be carried out beforehand.

The transistor may be produced in a known manner. An illustrative example is shown in FIGS. 5*a* to 5*h* and the transistor obtained corresponds to that illustrated in FIG. 3*a*.

Figure 5A:
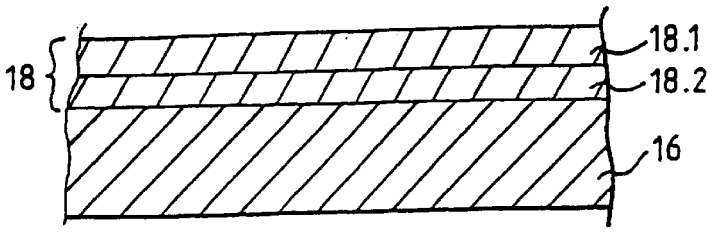
FIGS. 5*a* to 5*h*, various steps for producing the semiconductor modulation element of a field-effect cathode according to the invention.

Deposited on a substrate 16 made of a semiconductor material having semi-insulating properties (for example, silicon carbide) is a more conductive coating 18 (FIG. 5*a*). It is preferable to produce this coating 18 as two layers 18.1 and 18.2, the $n^+$-doped surface layer 18.1 being the contact layer and the layer 18.2 between the substrate 16 and the contact layer 18.1 being the n-doped active layer. These layers, for example made of silicon carbide SiC or gallium nitride GaN, may be deposited by epitaxy, whether it be liquid phase epitaxy (LPE), vapour phase epitaxy (VPE) or molecular beam epitaxy (MBE), or else by ion implantation.

Figure 5B:
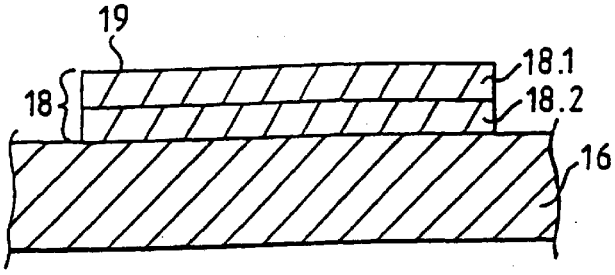

By reactive ion etching right down to the substrate 16, a plateau or mesa 19 is formed (FIG. 5*b*).

Figure 5C:
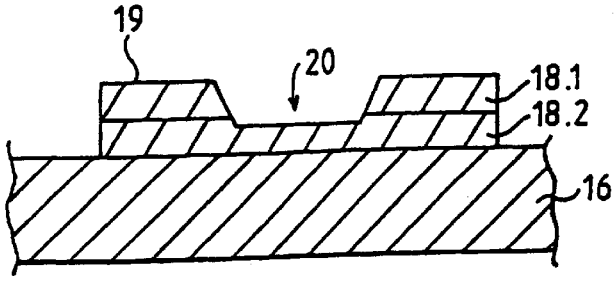

A trench 20 is produced in the contact layer 18.1 in a central region of the mesa 19 by reactive ion etching (FIG. 5*c*).

Figure 5D:
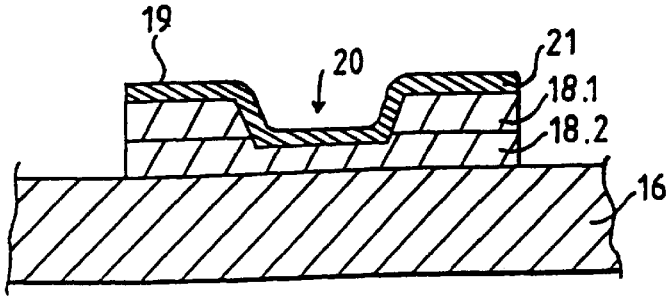

A passivation layer 21 is then usually deposited (FIG. 5*d*). This may be made of silica $SiO_2$ or silicon nitride $Si_3N_4$, for example.

Figure 5E:
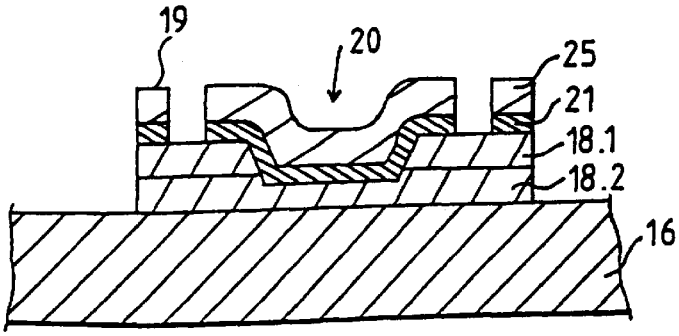
Figure 5F:
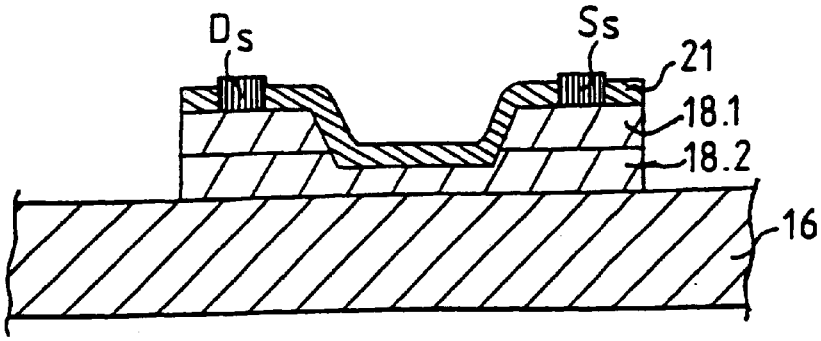

The ohmic contacts $D_s$ and $S_s$ are deposited after an operation of etching the passivation layer 21 down to the contact layer 18.1, this operation being preceded by a masking operation, for example using lithography (FIG. 5*e*). The two ohmic contacts $D_s$ and $S_s$, which are substantially identical, are then deposited, preferably at the same time, by sputtering or evaporation in the etched locations. They are usually made of nickel. Next, the resin 25 used in the masking operation is removed (FIG. 5*f*).

Figure 5G:
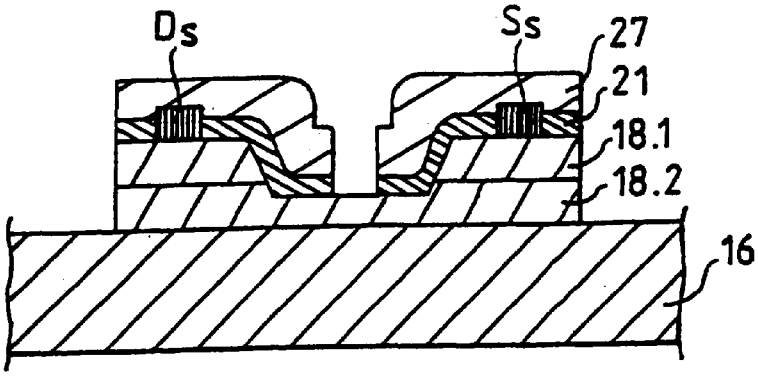
Figure 5H:
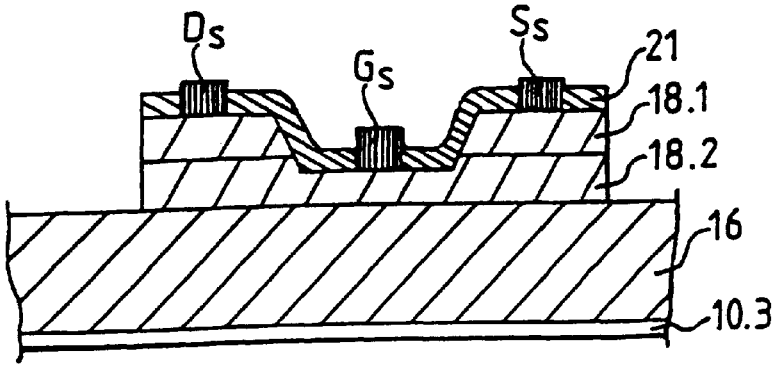

The Schottky contact $G_s$ is deposited separately, followed by carrying out, in the trench 20, an operation of etching the passivation layer 21 down to the active layer 18.2, this operation being preceded by a masking operation using, for example, lithography (FIG. 5*g*). The Schottky contact $G_s$, for example made of titanium, is deposited by sputtering or evaporation in the etched location and then the resin 27 used in the masking operation is removed. The next operation is to produce a metallization layer (labelled 10.3) on the opposite side of the substrate 16 from that carrying the contacts, in order to be able to fasten the semiconductor modulation element to the dielectric support 100 by soldering, for example using a gold solder (FIG. 5*h*).

In the foregoing description, the electrical links to the tip array A and to the semiconductor modulation element S are in the form of wires 20.1. It may be advantageous to reduce the number of wire links, or even to eliminate them.

Figure 7A:
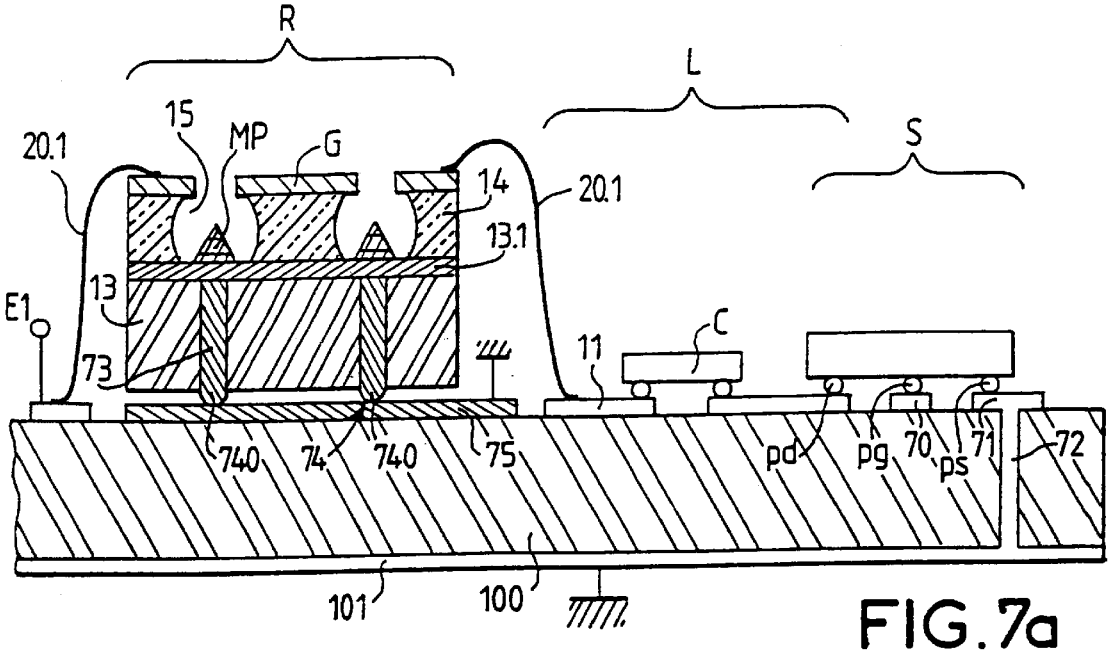
FIGS. 7*a* to 7*d*, further examples of cathodes according to the invention in which certain wire links have been eliminated.
Figure 7B:
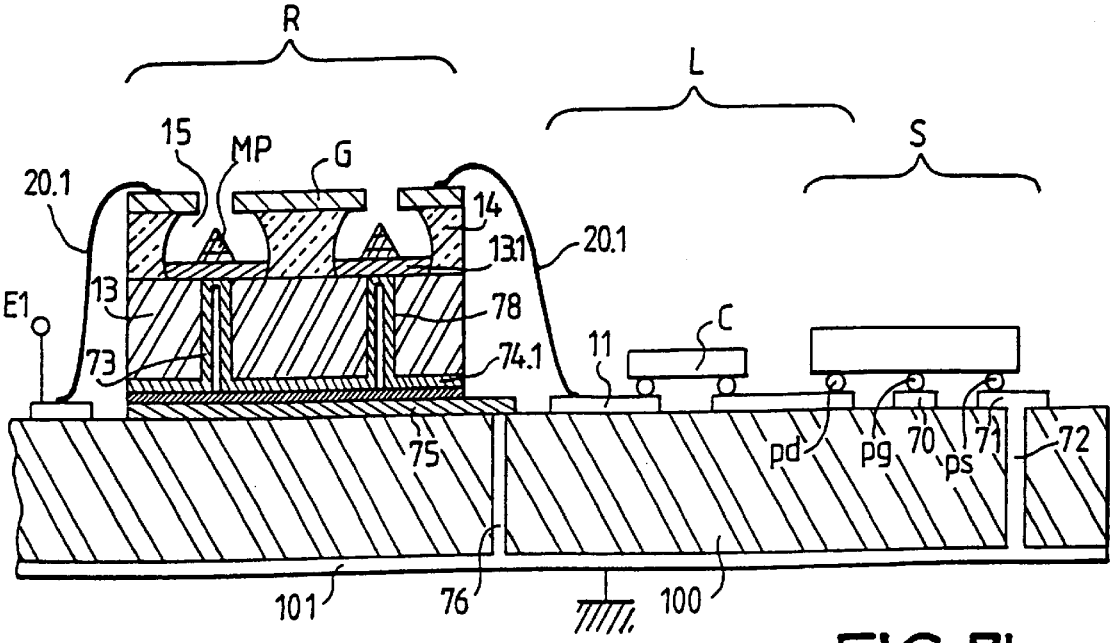

To do this, it is possible to use a semiconductor modulation element compatible with a mounting technique known by the name of flip-chip. With regard to the tip array A, this may also be compatible with this type of mounting technique. FIGS. 7*a*, 7*b* illustrate this configuration. In the tip array A, a wire link may have a perturbing effect on the electron emission pattern. A wire link is equivalent to a parasitic inductance.

From the standpoint of the useful area of the dielectric support 100, it is possible to reduce it by eliminating certain wire links since certain conducting pads, for example, the local earth pad in the case of the ET, may also be eliminated. This reduction in area is advantageous.

The semiconductor modulation element S shown schematically is of the transistor type. It comprises three studs: a drain stud $C_d$, a source stud $C_s$ and a gate stud $C_g$ each coming into electrical contact with an appropriate conducting contact pad on the dielectric support 100. More particularly the drain stud $C_d$ comes into contact with the strip 11 of the microline L, the gate stud $C_g$ comes into electrical contact with a conducting pad 70 via which the modulation signal to be amplified is conveyed, while the source stud $C_s$ comes into contact with a conducting pad 71 connected to the local earth via a plated-through hole 72 which, for example, passes through the dielectric support 100. The studs $C_d$, $C_g$, and $C_s$ also play a mechanical role in holding the semiconductor modulation element S in place on the dielectric support 100, the mechanical link possibly being formed by fusion between the studs and the conducting pads.

The tip array A will now be described in greater detail, in which a contact 74 of the tips ET is formed at the base of an array on the opposite side from the tips. This tip array A could be used independently of the semiconductor modulation element S and of the microline L. In the example shown in FIG. 7*a*, the electrically insulating or semi-insulating substrate 13 is pierced right through by at least one hole 73. This hole runs into the electrically conducting or semiconducting layer 13.1 supporting at least one tip ET. It is plumb with a tip ET.

FIG. 7*a* again shows the dielectric layer 14 which includes the cavities 15 and the grid G, without any modification with respect to what is shown in FIG. 3*a*.

This hole 73 is plated internally with metal and is extended on the opposite side from the tips ET by a contact 74 in the form of a conducting stud 740. It is this stud 740 which contributes to the electrical connection of the tips ET and to the mechanical fastening of the tip array A to the dielectric support 100. This stud 740 is in electrical contact with a conducting pad 75 carried by the dielectric support 100, this conducting pad 75 being connected in the example to the local earth by any suitable means.

As illustrated in FIG. 7*b*, it is possible to envisage the tip contact 74 not in the form of a conducting stud. In this new embodiment, the hole 73 is metallized on its walls, this metallization 78 forming an end wall on the same side as the tips ET and emerging on the opposite side from the tips, forming a rim 741 which comes into electrical and mechanical contact with an appropriate conducting pad 75 on the dielectric support 100. This connection may be made by soldering. In the example, this conducting pad 75 is connected to the local earth via a plated-through hole 76 which passes through the dielectric support 100 as far as the local earth plane 101. The metallization 76 is not hatched in order not to clutter up the figure.

In the example shown in FIG. 7*b* there are as many holes 73 as there are tips ET and the electrically conducting or semiconducting layer 13.1 supporting the tips ET is discontinuous, taking the form of discs each serving as base for a tip ET. In the examples shown in FIGS. 3 and 7*a*, the layer 13.1 is continuous, forming a carpet under the tips.

Figure 7C:
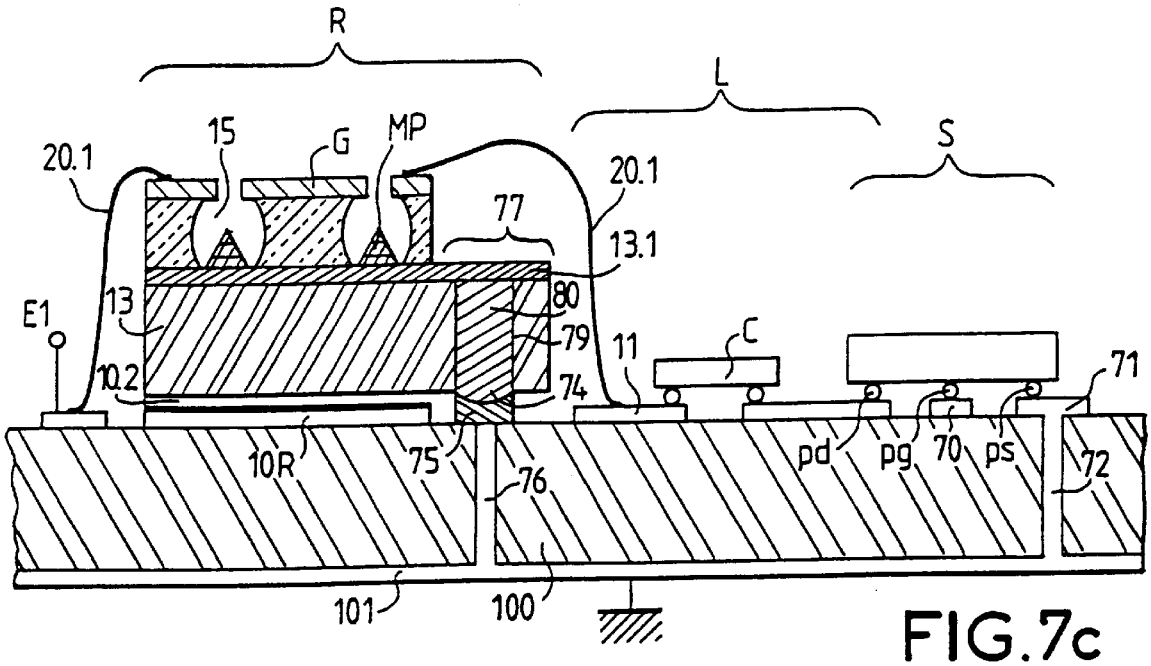

The holes 73 must have a relatively small diameter if the tip density in the array is high. The order of magnitude of their diameter is less than one micrometre. Production of these holes is tricky. To avoid producing holes which are too fine, the electrically conducting or semiconducting layer 13.1, which in this embodiment is continuous from one tip to another, may be extended by a region 77 containing no tip ET. This embodiment is illustrated in FIG. 7*c*. One or more holes 79 are therefore drilled through the electrically insulating or semi-insulating substrate 13 and these holes may be less fine than those plumb with the tips ET.

The metallization 80 of the holes is similar to that which has just been described in the case of FIG. 7*a* or 7*b* and the contact 74 for the tips on the opposite side from the tips takes the form either of a stud or a rim. The electrical connection of the tip contact 74 may be similar to that shown in FIGS. 7*a*, 7*b*. The tip array may be mechanically connected to the dielectric support 100 as in the examples shown in FIG. 3.

Another very important advantage of bringing a tip ET contact at the base of the tip array A through the electrically insulating or semi-insulating substrate 13 is that the thickness of insulating material between the grid G and this tip contact is considerably increased. Consequently, the grid-tip capacitance is significantly reduced. In FIG. 3*a*, the thickness to be taken into consideration is that of the dielectric layer 14 comprising the cavities 15, whereas in FIG. 7*a* it is that of the dielectric layer 14 comprising the cavities 15 and that of the electrically insulating or semi-insulating substrate 13. The orders of magnitude of the thicknesses are as follows: approximately one micrometre in the case of the dielectric layer 14 comprising the cavities 15 and approximately 300 micrometres in the case of the electrically insulating or semi-insulating substrate 13. The energy needed to charge the grid-tip capacitance may be reduced for the same electron emission.

Figure 7D:
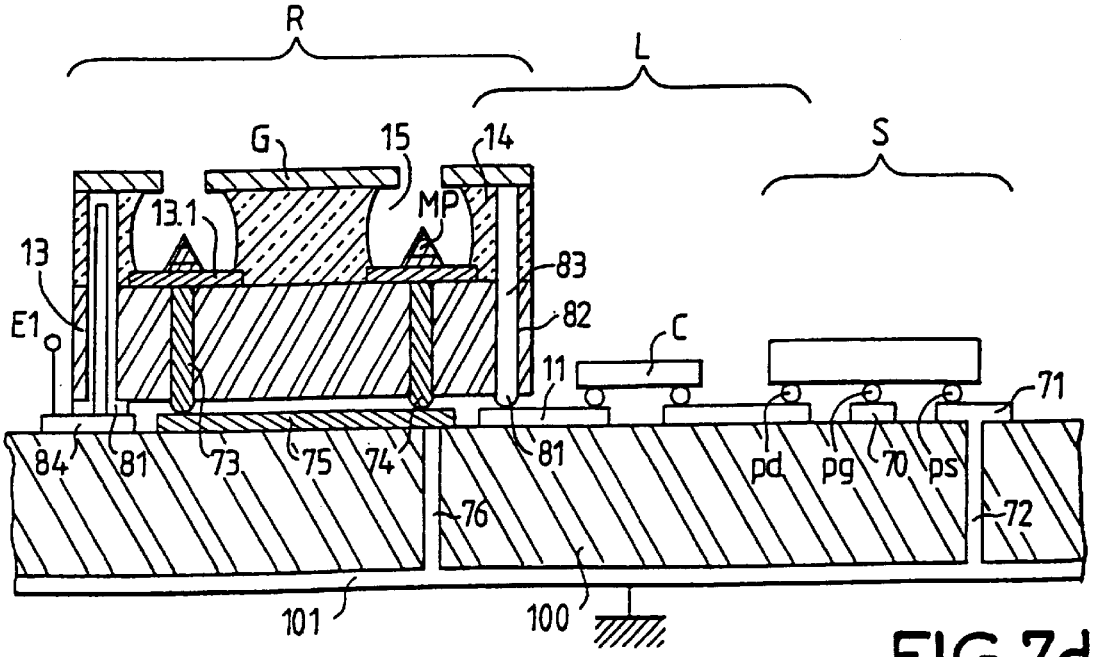

It may also be advantageous to eliminate the wire links from the grid G and to make a grid contact 81 at the base of the tip array on the opposite side from the grid. FIG. 7*d* shows this configuration. One or more holes 82 have been produced from the grid down to the base of the tip array through, on the one hand, the dielectric layer 14 with the cavities 15 and, on the other hand, the electrically insulating or semi-insulating substrate 13. These holes are metallized and matters are taken to ensure that the metallization 83 is not in electrical contact with the electrically conducting or semiconducting layer 13.1 supporting the tips ET, which layer may therefore be discontinuous and again form discs, as in FIG. 7*b*.

At the base of the tip array A, the metallization 83 terminates in the contact 81 in the form of a stud or a rim, both embodiments being shown in FIG. 7*d*.

In the example shown in FIG. 7*d*, one of the contacts 81 (the one in the form of a stud) comes into mechanical and electrical contact with the strip 11 of the microline L and the other contact (that in the form of a rim) comes into mechanical and electrical contact with a conducting pad 84 carried by the dielectric support 100 and connected to the bias voltage source E1.

From the implementation standpoint, the holes may be obtained by RIE. The electrically conducting layer 13.1 and/or the gate G may be made of nickel, which is not attacked by the etching if the latter is carried out after the dielectric layer 14 and the grid G have been deposited. The holes may be metallized in several layers, based on titanium, nickel or gold for example. The studs and the rims may also be made of these materials.

Referring again to FIG. 3*a*, the microline L does not merely electrically connect the semiconductor modulation element S to the tip array A. It also has a matching function, since the semiconductor modulation element S and the tip array A generally have very different output impedences. The impedance of the semiconductor element may be of the order of a few ohms to a few tens of ohms, whereas that of the tip array is of the order of an ohm or a tenth of an ohm.

The strip 11 of the microstrip line has a geometry which is suitable for fulfilling this function of matching between the tip array A and the semiconductor modulation element S. The thickness of the insulating substrate 12 contributes to this matching function.

Measures are taken for the thickness of the semiconductor modulation element S to be of the order of or slightly greater than that of the tip array A in order not to prevent extraction of the electrons or to deflect their paths. A maximum difference of the order of ten micrometres is acceptable.

During operation of the cathode, the voltages to be applied to the grid G of the tip array may be such that the microline L and possibly the tip array A are connected to bias voltage sources. FIG. 6*a* shows, seen from above, a cathode according to the invention. The semiconductor modulation element S is always a MESFET transistor. Its source $S_s$ earthed, its gate $G_s$ connected to a bias voltage source E3 receives the microwave modulation signal MW and its drain $D_s$ is connected to a first end of the microline L, which is shown as a microstrip line.

The second end of the microline L is connected to the grid G of the tip array A. The geometry of the strip of the line L, divided into two lengths 11.1, 11.2 joined together by a capacitor C, allows matching between the transistor S and the tip array A. The microstrip line L is connected to a bias voltage source E2 on the same side as its first end. This bias is applied to the drain $D_s$ of the transistor S. The wire links at both ends of the microline L are denoted by 20.1.

The tips ET of the tip array are connected to earth. This connection is made by an extension of the electrically conducting or semiconducting layer 13.1, without the covering by a dielectric layer, this extension being shown in FIG. 7*c*.

In the example shown, the grid G of the tip array A is connected to a bias voltage source E1.

Decoupling means C', L1, L2 and L3 have been inserted in a manner completely conventional for those skilled in the art. For this purpose, there is a capacitor C' between the gate $G_s$ of the transistor S and the input of the microwave modulation signal MW, an inductor L3 between the bias voltage source E3 and the gate $G_s$ of the transistor S, an inductor L2 between the bias voltage source E2 and the microstrip line L (on the drain $D_s$ side of the transistor S), and an inductor L1 between the bias voltage source E1 and the grid G of the tip array A.

Figure 6B:
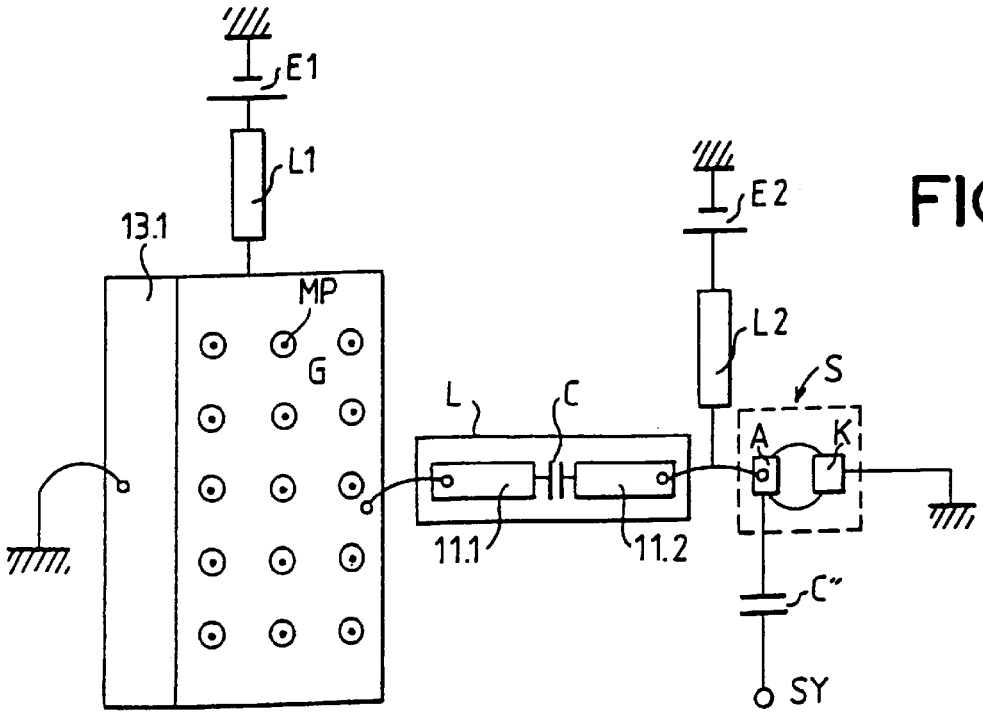

Likewise, FIG. 6*b* illustrates a cathode according to the invention, in which the semiconductor modulation element S is a diode. The only differences from the diagram in FIG. 6*a* relate to the diode connections. The cathode CA of the diode is connected to earth and the anode AN is connected to the first end of the microline L, which is also connected to the bias voltage source E2. A synchronization signal SY may be injected onto the anode AN of the diode. The synchronization signal SY may be electrical and a decoupling capacitor C" is then placed between the anode AN and the input of the synchronization signal SY. The synchronization signal could be optical and in this case the semiconductor modulation element S would be an optical component, such as a photodiode.

Instead of the cathode according to the invention comprising a tip array A and a semiconductor modulation element S in the form of discrete components, it is possible for the cathode according to the invention to be monolithic.

Figure 8:
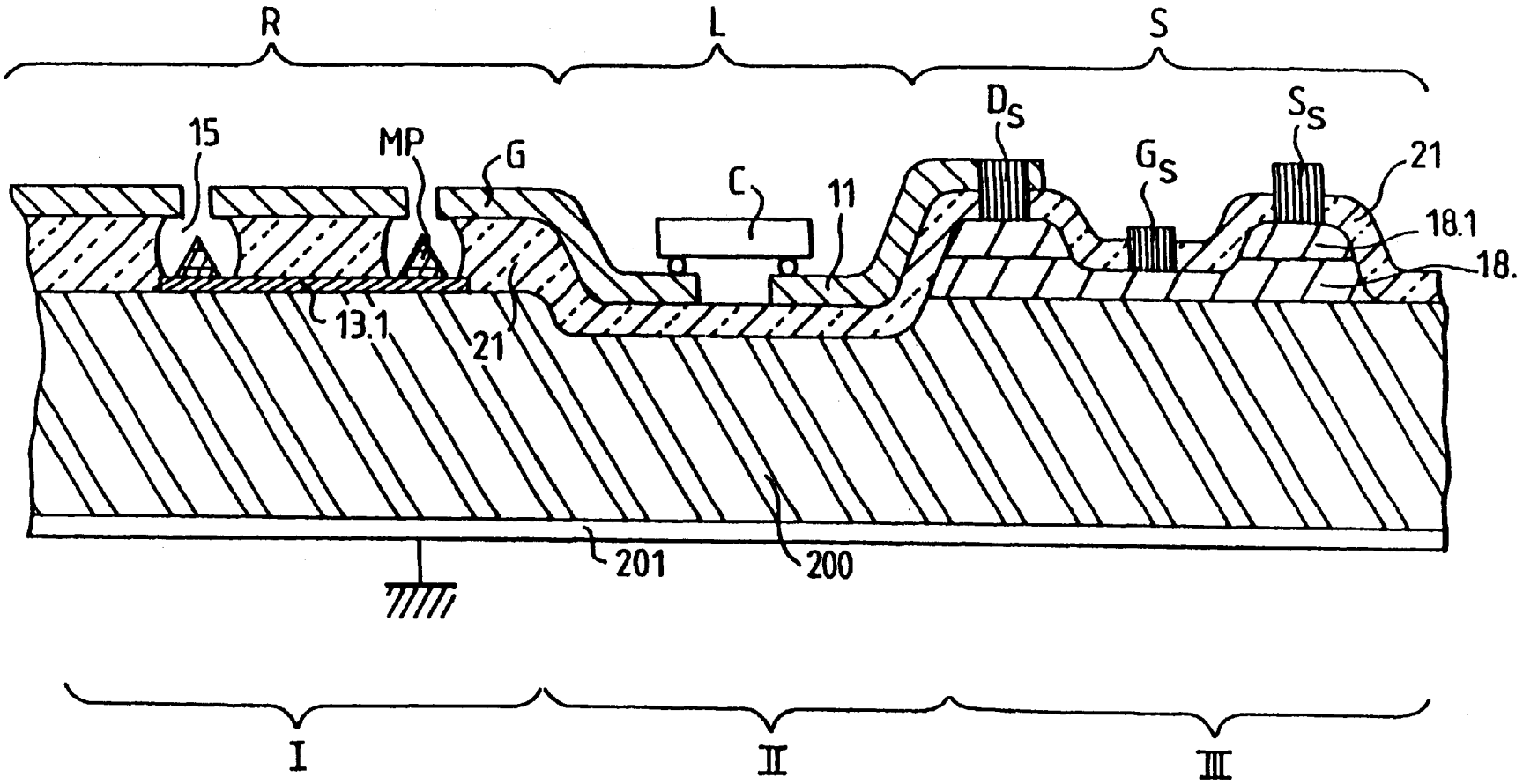
FIG. 8, an example of a monolithic field-effect cathode according to the invention.

FIG. 8 shows such a monolithic cathode. The electrical connections to the local earth or to a bias voltage source have not been shown for the sake of clarity, but they may be produced using one of the methods described above. The tip array A, the microline L and the semiconductor modulation element S are integrated on the same semiconductor substrate 200 made of a material having semi-insulating properties such as, for example, silicon carbide. From the heat dissipation standpoint, this is entirely satisfactory.

This common substrate 200 has one of its main sides coated with a conducting layer 201 which serves as a local earth plane. Defined on the other main side are a region I for at least one tip array A, a region II for the microline L and a region III for the semiconductor modulation element S.

The semiconductor modulation element S is produced in the region III and this production may be carried out as illustrated in FIG. 5, the substrate 200 then being equivalent to the substrate 16.

The tip array A is produced in the region I and this production may be carried out as illustrated in FIG. 4, the substrate 200 then being equivalent to the electrically insulating or semi-insulating layer 13.

The microline L is produced in the region II and its structure is equivalent to that shown in FIG. 3*b*. The substrate 200 corresponds in practice to that denoted by 100 in FIG. 3*b*.

With such a configuration, the drain of the transistor, the strip of the microline and the grid of the tip array may then be formed during the same step in the same material.

Likewise, the passivation layer 21 of the semiconductor modulation element, made of a dielectric, may extend into the region II, covering the substrate 200, and into the region I, forming the dielectric layer which includes the cavities 15.

Instead of producing a tip array A comparable to that shown in FIG. 3*a* with wire links, it is possible for it to be comparable to one of the examples in FIG. 7, that is to say with tips connected to the earth plane 201 via at least one plated-through hole passing through the substrate 200.

Such a monolithic field-effect cathode is very beneficial as it is compact and costs less than a cathode comprising discrete components, as it uses fewer materials and it takes less time to produce it.

What is claimed is:

1. Microwave modulable field-effect cathode, comprising at least one array of emissive tips, and means for producing a microwave modulation signal to be sent to the tips, in which cathode the means for producing a modulation signal comprise at least one semiconductor element placed very close to the tip array, and an impedance-matching microline is interposed between the semiconductor element and the tip array in order to convey the modulation signal from the semiconductor element to the tip array.

2. Field-effect cathode according to claim 1, wherein the microline is a line comprising a conducting strip connected at one of its ends to a tip array and at the other end to the semiconductor modulation element.

3. Field-effect cathode according to claim 1, wherein the semiconductor modulation element is of the transistor type or of the diode type.

4. Field-effect cathode according to claim 1, wherein the microline has a conducting strip divided into two lengths joined together by a capacitor.

5. Field-effect cathode according to claim 1, wherein the microline is connected to a bias voltage source.

6. Field-effect cathode according to claim 1, wherein the microline is connected to the semiconductor modulation element and/or to the tip array via a wire link.

7. Field-effect cathode according to claim 1, wherein at least one element taken from among the tip array, the semiconductor modulation element, and the microline is a discrete component.

8. Field-effect cathode according to claim 7, wherein at least two elements taken from the tip array, the semiconductor modulation element, and the microline are attached to a same electrically insulating or semi-insulating support.

9. Field-effect cathode according to claim 8, wherein the two elements are mounted on one side of the support, and the other side of the support is coated with a conducting layer which serves as a ground plane.

10. Field-effect cathode according to claim 8, wherein the microline is integrated into the electrically insulating or semi-insulating support.

11. Field-effect cathode according to claim 7, wherein the semiconductor modulation element is compatible with a flip-chip technique.

12. Field-effect cathode according to claim 7, in which the tip array comprises an electrically insulating or semi-insulating substrate with, on one side, a conducting or semiconducting layer, emissive tips in electrical contact with the conducting or semiconducting layer, a dielectric layer provided with cavities, each housing one of the tips, the dielectric layer being surmounted by a conducting grid which at least partially surrounds the cavities, wherein passing through the substrate is at least one plated-through hole which is used to electrically connect the tips to the other side of the electrically insulating or semi-insulating substrate.

13. Field-effect cathode according to claim 12, wherein the plated-through hole is extended by an electrical contact.

14. Field-effect cathode according to claim 7, in which the tip array comprises an electrically insulating or semi-insulating substrate with, on one side, a conducting or semiconducting layer, emissive tips in electrical contact with the conducting or semiconducting layer, a dielectric layer provided with cavities, each housing one of the tips, the dielectric layer being surmounted by a conducting grid which at least partially surrounds the cavities, wherein passing through the substrate and the dielectric layer are at least one plated-through hole which is used to electrically connect the grid to the other side of the substrate.

15. Field-effect cathode according to claim 1, wherein the tip array, the microline, and the semiconductor modulation element, are integrated on a same semiconductor substrate.

16. Field-effect cathode according to claim 15, wherein the semiconductor substrate is made of a semi-insulating material such as silicon carbide.

17. Field-effect cathode according to claim 15, wherein the microline has a strip which is extended on one side to form a grid for the tip array and on the other side to form a contact for the semiconductor modulation element.

18. Cathode according to claim 1, wherein the microline has a length not exceeding several hundreds of micrometres.

* * * * *